US005238012A

United States Patent [19]

Coronato

[11] Patent Number: 5,238,012

[45] Date of Patent: Aug. 24, 1993

[54] PAINT ROLLER CLEANER APPARATUS

[76] Inventor: Mario C. Coronato, 620 E. Burr Oak Dr., Lake Zurich, Ill. 60047

[21] Appl. No.: 995,752

[22] Filed: Dec. 23, 1992

[51] Int. Cl.[5] ..... B08B 3/02

[52] U.S. Cl. ..... 134/140; 134/153; 134/157; 134/200; 134/900

[58] Field of Search ..... 134/137, 140, 153, 157, 134/200, 900, 138; 68/213

[56] References Cited

U.S. PATENT DOCUMENTS

| | | | |
|---|---|---|---|
| 2,881,533 | 4/1959 | Johnson | 134/900 X |
| 3,436,264 | 4/1969 | Allen | 134/900 X |
| 3,608,120 | 9/1971 | Seiler | 134/900 |
| 3,696,457 | 10/1972 | Hand . | |
| 3,897,797 | 8/1975 | Wright et al. . | |
| 3,998,656 | 12/1976 | Grotto | 134/157 X |
| 4,130,443 | 12/1978 | Dulin | 134/140 X |
| 4,294,272 | 10/1981 | Klaiber | 134/138 |
| 4,377,175 | 3/1983 | Fritz . | |
| 4,545,395 | 10/1988 | Kolb . | |
| 4,809,722 | 3/1987 | Pennise | 134/200 X |
| 5,005,598 | 4/1991 | Hodgdon . | |
| 5,156,861 | 10/1992 | Tsuchiya et al. | 134/157 X |

FOREIGN PATENT DOCUMENTS

| | | | |
|---|---|---|---|
| 2355843 | 5/1975 | Fed. Rep. of Germany | 134/900 |
| 2219732 | 12/1987 | United Kingdom | 134/900 |

*Primary Examiner*—Frankie L. Stinson
*Attorney, Agent, or Firm*—Charles F. Meroni, Jr.

[57] ABSTRACT

A paint roller cleaning apparatus comprising a tubular barrel-shaped roller container. The container includes two C-shaped sections. A hinge joins the C-shaped sections along adjacent edges and with the C-shaped sections being relatively movable to one another into open and closed positions for enabling a paint roller to be inserted into the container for cleaning. A motor is retainingly mounted on one end of the tubular barrel-shaped roller container. A roller coupler is located inside of the tubular barrel-shaped roller container and is connected to the motor for driving connection to one end of a paint roller to rotate a paint roller within the tubular barrel-shaped roller container. One of the C-shaped sections has longitudinally spaced notches along its length for receiving a roller handle arm enabling a portion of the arm to be extended from inside the tubular barrel-shaped roller container through any one of the notches exteriorly of the tubular barrel-shaped roller container so that arms of paint rollers of different lengths can be supported in a selected one of the notches. A removable cap is mounted on an opposite end of the tubular barrel-shaped roller container. A tubular water spray bar is fixedly mounted inside of the tubular barrel-shaped roller container for spraying water on an outside surface of a paint roller as it is rotated by the motor. The cap has a fluid outlet for discharge of water from a lower end of the container. Means is fixedly mounted interiorly of the tubular barrel-shaped roller container for supporting an opposite end of a paint roller adjacent to the cap.

14 Claims, 4 Drawing Sheets

PAINT ROLLER CLEANER APPARATUS

BACKGROUND OF THE INVENTION

1. Field of the Invention

The present invention relates itself to a portable motorized paint roller cleaning apparatus. This apparatus is particularly constructed so that it can function to clean hand operated paint roller structures having paint spreading sleeves mounted thereon which roller structures and sleeves can be of different lengths as may be required by a painter. More particularly, a preferred embodiment of my paint roller cleaning apparatus can be conveniently used for cleaning three different lengths of paint sleeves.

My paint roller cleaning apparatus is particularly advantageous since the sleeve does not need to be removed from the paint roller when being cleaned as the head of the paint roller structure as well as the paint spreading sleeve can be inserted in totality into my paint roller cleaning apparatus. This apparatus is also motorized so that when the head structure of the paint roller cleaning apparatus is inserted into that portion of the apparatus that comprises a tubular barrel-shaped roller container, it can then be coupled to the motor and the motor can be activated in any conventional manner to cause the paint covered sleeve to be rotated in adjacency to an elongated water spray manifold or sleeve. When this manifold or sleeve is connected to a pressurized water source, the water can be caused to flow into a spray bar or manifold and then discharged out through ducts in the sspray bar directly against the paint covered roller sleeve as the roller sleeve rotates so that the roller sleeve can be progressively cleansed by the pressurized fluid or water. Any fluids that are collected during the cleaning operation can be discharged through a discharge port at the bottom end of the paint roller cleaning apparatus and caused to be collected in a suitable sump or a drain, as may be desired.

2. Description of the Prior Art

A search of records within the United States Patent and Trademark Office was undertaken to determine prior art devices, and certain patents were uncovered, as discussed below:

Hand, U.S. Pat. No. 3,696,457 discloses an apparatus for cleaning paint rollers that includes a closed housing in which a roller that has been saturated with solvent can be rotatably mounted. The entire cleaning operation is confined to the interior of the housing of the apparatus.

Wright, et al., U.S. Pat. No. 3,897,797 relates to a paint applicator roller cleaner which provides for a tubular housing structure with a free drainage system. An adjustable spray header is disclosed which can permit variation in the angle of the water jet as it is directed toward cleaning the paint roller.

Fritz, U.S. Pat. No. 4,377,175 discloses a pair of frustoconical bearings used within an elongated cylindrical device into which the paint roller is placed. Cleaning fluid is then placed on the roller from a variety of orifices onto the device.

Hodgdon, U.S. Pat. No. 5,005,598 discloses an elongated tubular housing for placement of the paint roller applicator. Means are provided for the rotation of the roller in the housing while cleaning fluid is applied.

It has been found that the problems associated with cleaning spent paint rollers has been discussed in the prior art. All references noted above suggest that the desired object of cleaning the roller is to prevent and preclude increased costs by simply being able to reuse the now clean roller. The search was conducted to locate those devices in the prior art which utilized a mechanical and/or "free standing" means to clean the paint roller.

SUMMARY OF THE INVENTION

According to my invention, I have provided a paint roller cleaning apparatus comprising a tubular barrel-shaped roller container. The container includes two C-shaped sections. Hinge structure joins the C-shaped sections along adjacent edges and with the C-shaped sections being relatively movable to one another into open and closed positions for enabling a paint roller to be inserted into the container for cleaning. A motor is retainingly mounted on one end of the tubular barrel-shaped roller container. A roller coupler is located inside of the tubular barrel-shaped roller container and is connected to the motor for driving connection to one end of a paint roller to rotate a paint roller within the tubular barrel-shaped roller container. One of the C-shaped sections has longitudinally spaced notches along its length for receiving a roller handle arm enabling a portion of the roller handle to be extended from inside the tubular barrel-shaped roller container through any one of the notches exteriorly of the tubular barrel-shaped roller container so that arms of paint rollers of different lengths can be supported in a selected one of the notches. A removable cap is removably mounted on an opposite end of the tubular barrel-shaped roller container. A tubular water spray bar is fixedly mounted inside of the tubular barrel-shaped roller container for spraying water on an outside surface of a paint roller as it is rotated by the motor. The cap has a fluid outlet for discharge of water from a lower end of the container. Means is fixedly mounted interiorly of the tubular barrel-shaped roller container for supporting an opposite end of a paint roller adjacent to the cap.

According to other important features of my invention, I have mounted the paint roller inside of a housing or a barrel-shaped roller container of my paint roller cleaning apparatus in a new and improved way, and I have also provided a motor to enable the roller to be power driven during the cleaning operation. It is believed that I have developed a new and new unique way for mounting my motor on my paint roller cleaning device and that I have developed a unique way of mounting or suspending the paint roller internally of the paint roller cleaning apparatus.

As a further important feature of my invention, I have developed a new slotted cover for selectively locking different sized paint roller structures into my paint roller cleaning apparatus so that it can function to be used for cleaning paint roller structures of different lengths.

According to other features of my invention, the C-shaped sections are preerably comprised of a synthetic plastic composition with one of the C-shaped sections being transparent enabling the user to view the interior of the tubular barrel-shaped roller container.

DESCRIPTION OF THE PREFERRED EMBODIMENT

Figure 1:
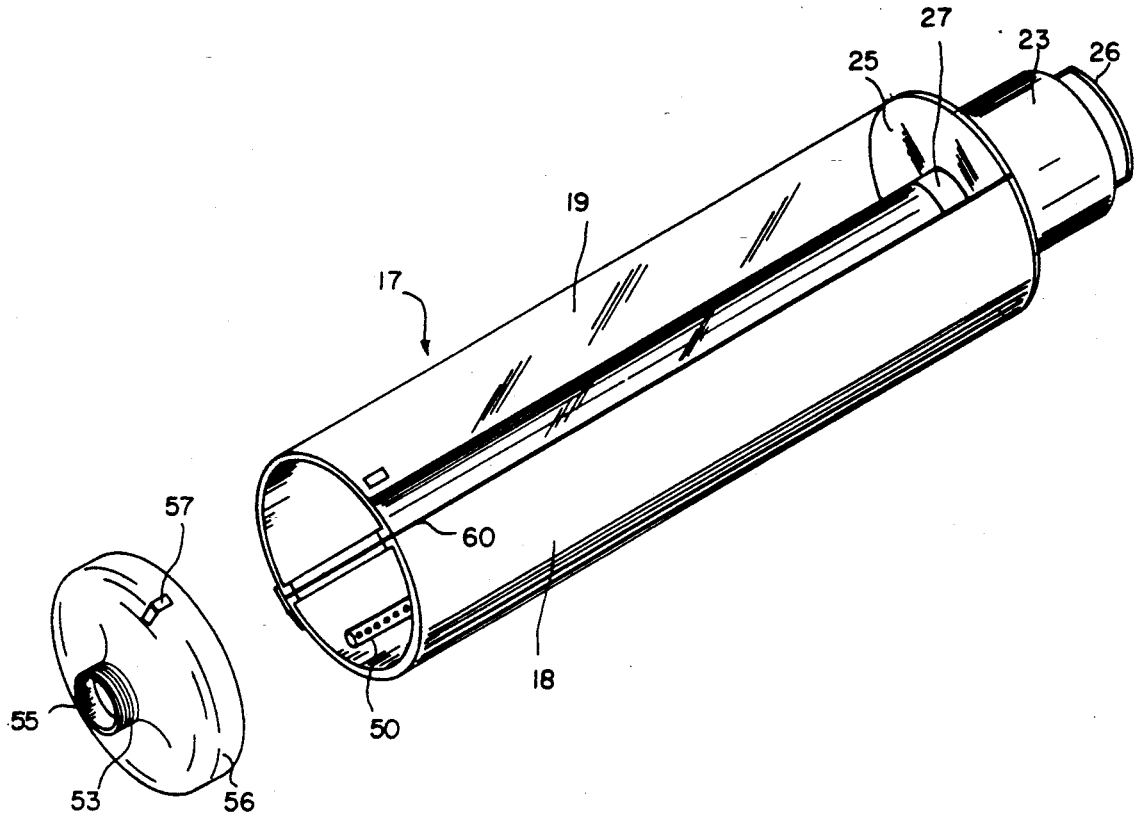
FIG. 1 is an enlarged partially exploded perspective view of my paint roller cleaning apparatus.

Turning now to the drawings in which like reference characters indicate corresponding elements throughout the several views, attention is first directed to FIG. 1, which shows an apparatus, generally designated by the reference character 10, constructed in accordance with the teachings of the instant invention for cleaning paint roller type structures or applicators of varying lengths. The paint roller cleaning apparatus 10 is particularly adapted for cleaning different sized paint rollers which have varying lengths as indicated at 11, 12 and 13 in FIG. 2. Typical roller lengths that are available in the marketplace are rollers having lengths of 6", 9" and 12". My apparatus 10 is adapted to accommodate all of these different sized rollers according to important features of my invention.

Each of the rollers are of a conventional construction, and include roller support structures of varying lengths as indicated at 14, 15 and 16. The rollers 11, 12 and 13 are mountable upon these structures.

The apparatus 10 comprises a tubular barrel-shaped roller container 17. The container is comprised of a pair C-shaped sections 18 and 19. A piano hinge 20 is provided for joining the C-shaped sections along adjacent section edges 21 and 22. The C-shaped sections are relatively movable with respect to one another as they are pivoted on the hinge 20 from open and closed positions as may be required.

A motor 23 of a conventional construction is mounted on one end 24 of the tubular barrel-shaped roller container 17, and more particularly on a circular end wall 25 of section 18. The motor 23 has a handle 26 to enable the apparatus to be held in an upright position during operation as will be discussed further hereafter. It is contemplated that different types of motors might be used. One type that is being considered is a battery manufactured by W.W. Grainer which is identified by Item No. 2M196. This type of motor is battery operated and is a 6 volt D.C. motor sold under the trademark "Perm Mag". It is believed that other types of motors could be utilized other than the one specified without departing from the scope of my invention.

Figure 2:
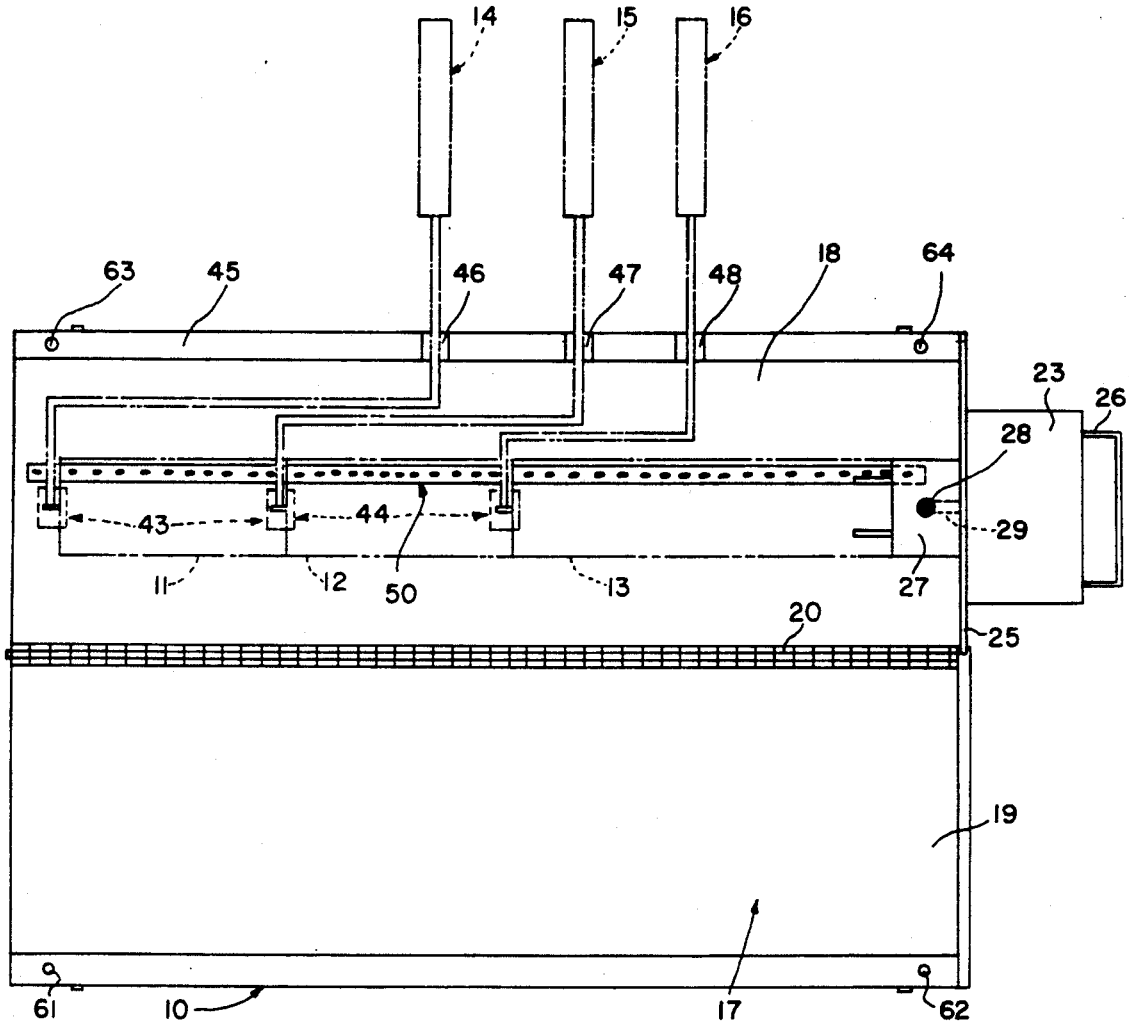
FIG. 2 is an enlarged side view of my tubular paint roller container with two C-shaped sections being shown in an open position disclosing the interior construction with varying sized paint rollers being illustrated in phantom lines showing how paint roller structures of different lengths can be mounted internally of the tubular barrel-shaped roller container.
Figure 5:
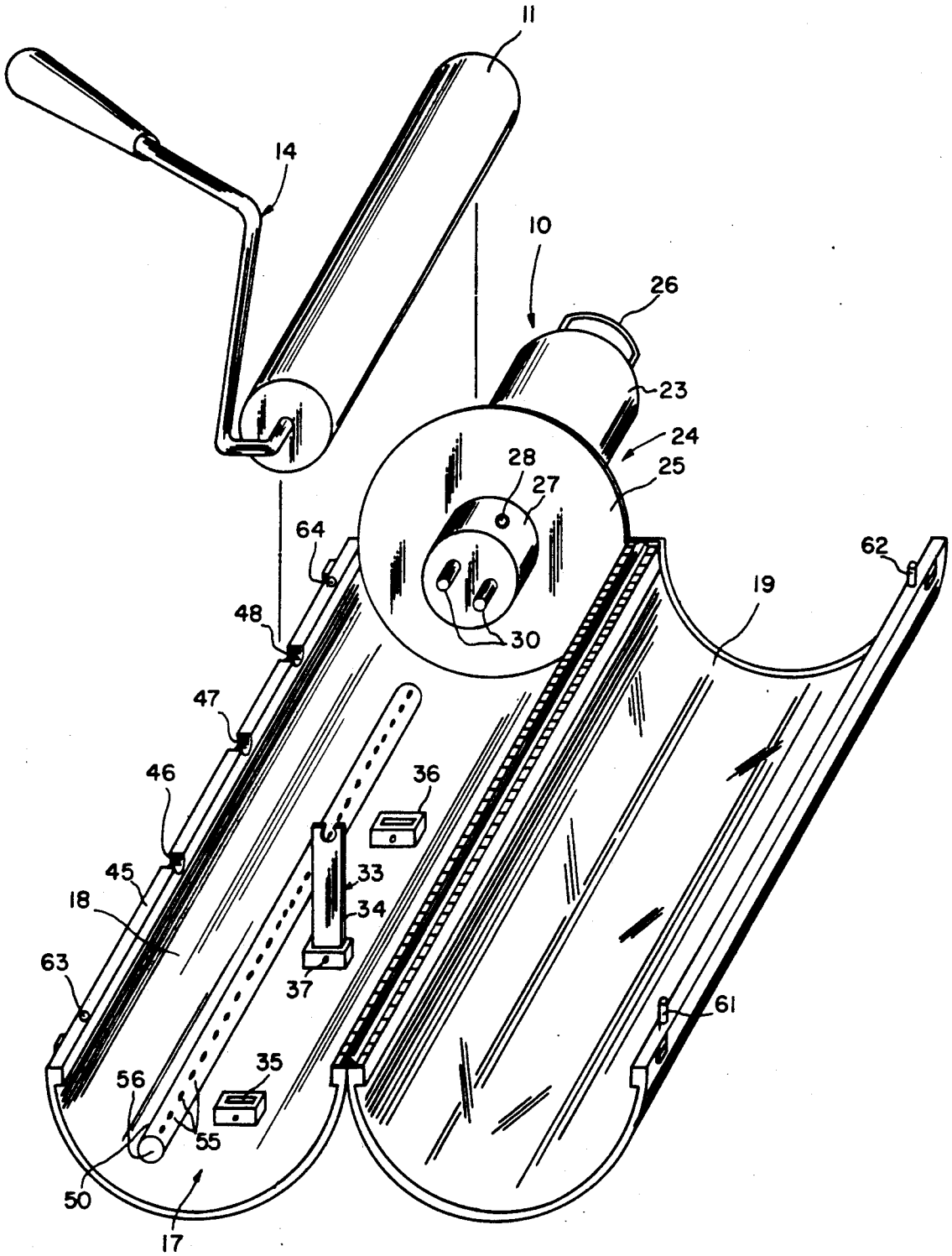
FIG. 5 is an exploded view of my paint roller cleaning apparatus showing the paint roller structure in adjacency thereto illustrating how one of the notches in the C-shaped section can be utilized to assist in fixing the position of the paint roller structure within the tubular barrel-shaped roller container.

As will be observed in FIG. 5, the motor 23 is mounted on one side of the end wall 25, a motor coupler 27 is mounted inside of the container 17 on an axially inner side of the end wall 25. A set screw 28 is provided which secures the motor coupler in co-rotative assembly with motor drive shaft 29 as seen in FIG. 2. Mounted on an axially inner end of the motor coupler 27 are a pair of prongs 30,30. These prongs are engageable with a roller coupler 31 in corresponding prong holes (not shown). The roller coupler 31 has another pair of prongs 32,32 which are engageable in corresponding holes (not shown) in an end cap in the roller structure 14 carrying paint roller or sleeve 11.

A roller coupler 31 is provided, and it has a pair of prongs 32,32 for engagement with an end cap (not shown) of a roller support structure 14. This roller coupler is co-axially aligned and attached by the motor coupler prongs 30,30 so that when the motor 23 is operated to cause its drive shaft 29 to be driven, the roller coupler 31 acting in conjunction with the motor coupler causes the roller 11, 12 or 13 to be circumferentially rotated inside of the chamber defined by the tubular barrel-shaped roller container 17.

In order to support an opposite end of one of the roller support structures 14, 15 or 16, a roller support arm structure 33 is provided. This structure 33 has an upright support arm 34. The support arm is mounted in a slot 35 provided on a support block 36. The support block can be integrally formed with the adjacent C-shaped section 18 particularly if these components are formed from a suitable synthetic plastic in a molding procedure as is well-known in the art. A lower end of the support arm is secured in place in the slot 35 by means of a retaining screw 37 that is threadingly engaged in a hole 38 provided in the support block 36. This retaining screw is threaded so that it not only is engaged in the hole 38, but also in a corresponding hole 39 that is co-axially aligned. Thus, when the support arm 34 is bottomed in the slot 35, the holes 38 and 39 are co-axially aligned for engagement by the retaining screw 37.

An upper end of the support arm provides a yoke as indicated at 40, and includes a U-shaped groove 41. A rod like handle arm structure 42 is provided on the roller support structure 14. It is this arm structure 42 that is engaged and supported in the groove 41 on the support arm. It is in this way that the roller support structure 14 and its roller or sleeve 11 are supported at opposite ends within the chamber defined by the container. The other roller support structures 15 and 16 are supported the same way only with the support arm 42 being mounted on other slotted blocks as hereafter discussed.

Mounted interiorally of the container and more particularly on the C-shaped section 18 are additional support blocks 43 and 44 (FIG. 2). Thus, if a larger size roller is to mounted within the tubular barrel-shaped roller container 17, the support arm structure can be moved to other blocks such as the blocks 43 and 44 and attached in position by the retaining screw 37 in the same manner just described. It is in this way that different size rollers or sleeves 11, 12 and 13 can be mounted within the roller container 17 as shown in FIG. 2.

In order to further accommodate the rod arm structure of each of the roller support structures 14, 15 and 16, an upper longitudinal edge 45 is notched at 46, 47 and 48. These notches 46, 47 and 48 are adapted to provide additional supports for the angularly shaped arm structure of each of the roller support structures 14, 15 and 16. This relationship is diagrammatically illustrated in FIG. 2 where all three angular arm structures of the roller support structures are illustrated in phantom lines to show the different ways that any one of them can be mounted at any given time in the tubular barrel-shaped roller container 17. Obviously, only one of these roller support structures 14, 15 and 16 can be mounted within the tubular barrel-shaped roller container 17 at any given point in time.

Figure 3:
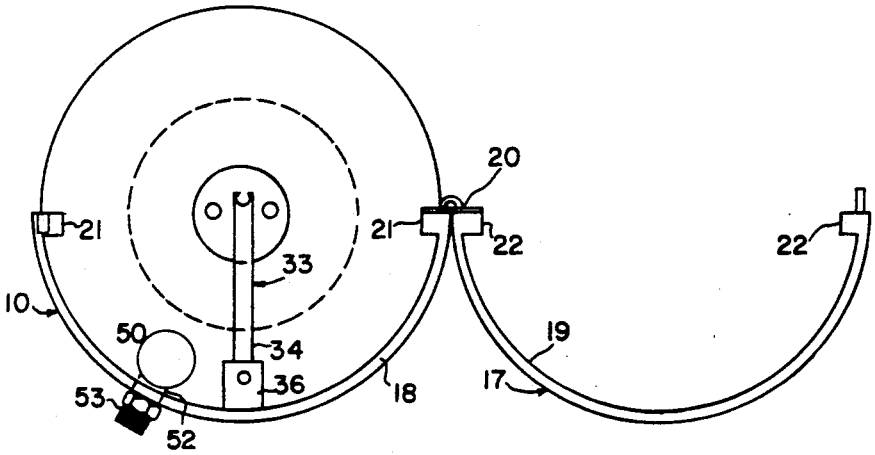
FIG. 3 is an end view of the paint roller cleaning apparatus as viewed from a left-hand side of FIG. 2.
Figure 4:
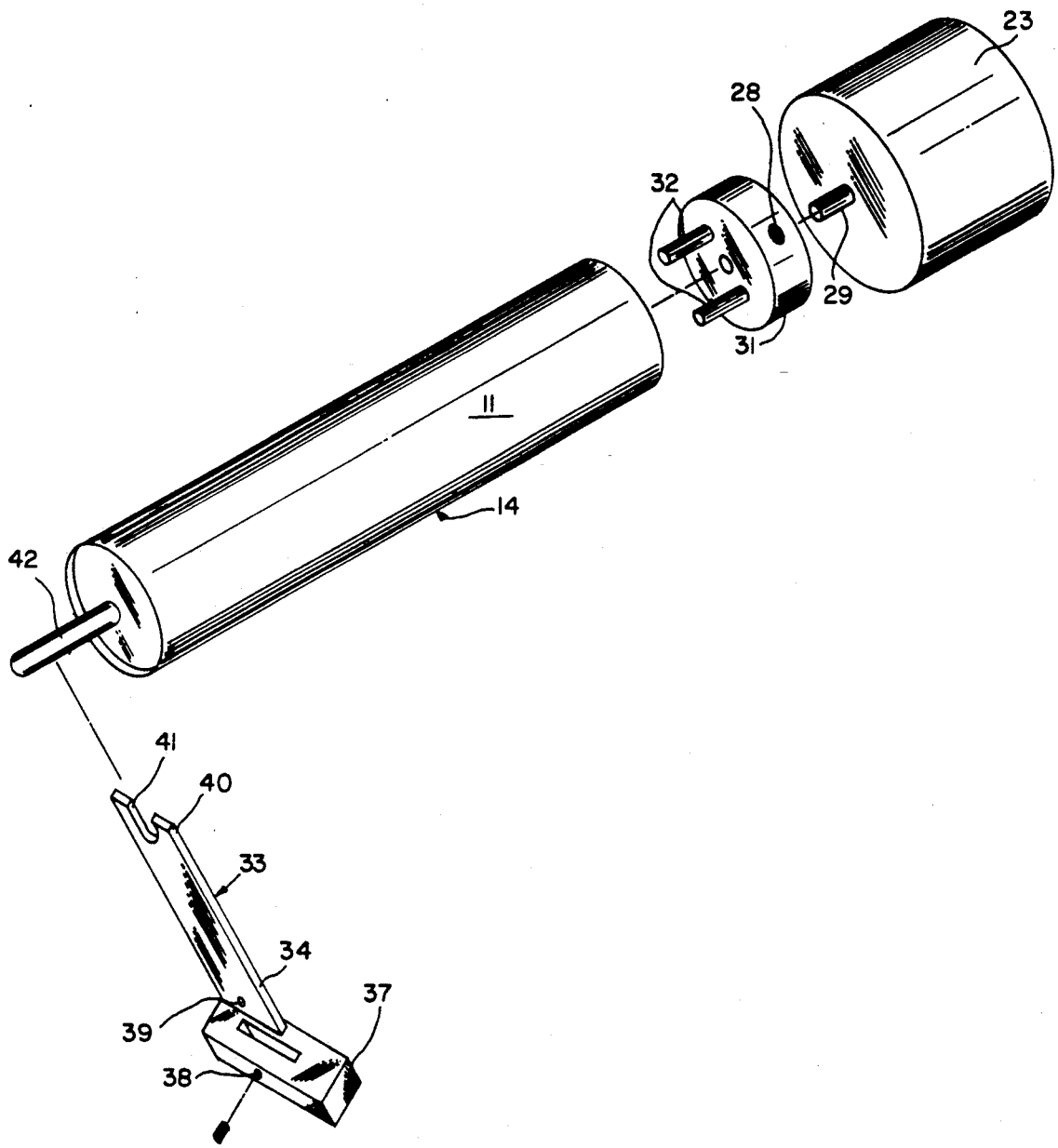
FIG. 4 is another exploded view showing the manner in which a paint roller can be supported internally of a paint roller cleaning apparatus, and how it can be coupled to an electric motor coupler.

Now to enable the rollers or sleeves 11, 12 and 13 to be cleansed, I have provided a tubular water pipe or spray bar or manifold 50 which has a series of axially spaced spray holes 51 to enable water or other cleaning fluid to be discharged through the bar or pipe 50 against the revolving outer surface of the paint roller or sleeve 11, 12 or 13. This pipe 50 has a water inlet 52 (FIG. 3). This water inlet 52 can be connected to a pressurized water hose (not shown) by threading it to the outside threaded fitting 53 (FIG. 3).

Now as the water is caused to strike the roller or sleeve 11, 12 or 13, it will then fall by gravity to a bottom end of the cylinder 17 and discharged through a discharge port 55 provided in end cap 56. This end cap 56 is located on an opposite end of the cylinder 17 at the end most remote from themotor and circular end wall 25. This end cap 56 is securable to the C-shaped section 19 by means of a hasp lock or the like as indicated generally at 57. Additional hasp locks 58 and 59 are provided to secure confronting opposite edges of the sections 18 and 19. The abutting edges are indicated generally 60 in FIG. 1.

In order to insure that the C-shaped sections 18 and 19 are properly aligned, these sections are provided with a pair of pins 61 and 62 in one edge on the section 19. The section 18 has a pair of holes 63,64 and the pins 61 and 62 are receivable in these holes 63,64 to assist in proper alignment of the sections 18 and 19 when the sections are in a closed position. FIG. 5 shows the pins 61 and 62 disengaged from the holes 63 and 64 when the sections 18 and 19 are in an open position. In FIG. 1, the sections 18 and 19 are shown in a closed position, and at this point in time the pins 61 and 62 are engaged in the holes 63 and 64 but are not there shown in FIG. 1, however.

As described above, this invention provides a number of advantages, some of which have been described above and others of which are inherent in the invention.

I claim:

1. A paint roller cleaning apparatus comprising a tubular barrel-shaped roller container, said container including two C-shaped sections, hinge means joining said C-shaped sections along adjacent edges and with the C-shaped sections being relatively movable to one another into open and closed positions for enabling a paint roller to be inserted into the container for cleaning, a motor retainingly mounted on one end of said tubular barrel-shaped roller container, a roller coupler being located inside of said tubular barrel-shaped roller container and being connected to said motor for driving connection to one end of a paint roller to rotate a paint roller within said tubular barrel-shaped roller container, one of said C-shaped sections having longitudinally spaced notches along its length for receiving a roller handle arm enabling a portion of the arm to be extended from inside said tubular barrel-shaped roller container through any one of the notches exteriorly of said tubular barrel-shaped roller container so that arms of paint rollers of different lengths can be supported in a selected one of said notches, a removable cap removably mounted on an opposite end of said tubular barrel-shaped roller container, a tubular water spray bar fixedly mounted inside of said tubular barrel-shaped roller container for spraying water on an outside surface of a paint roller as it is rotated by said motor, the cap having a fluid outlet for discharge of water from a lower end of the container, and means fixedly mounted interiorly of said tubular barrel-shaped roller container for supporting an opposite end of a paint roller adjacent to said cap.

2. The paint roller cleaning apparatus of claim 1 wherein one of the C-shaped sections has said motor mounted at an upper end thereof and further with said longitudinally spaced notches being on an unhinged edge for supporting an angular rod-like handle structure on a paint roller structure in one of said spaced notches while a paint roller is being cleaned, and notched means in said tubular barrel-shaped roller container adjacent said cap for supporting a free end of the paint holder co-axially centered in said container.

3. The paint roller cleaning apparatus of claim 2 wherein said one of the C-shaped sections has a series of longitudinally spaced support blocks attached thereto, said blocks having support arm slots, an upright support arm engageable in any one of said slots and oriented for supporting said roller support structure at its end remote from said motor whereby the roller support structure is supported at opposite ends for free rotary movement within said container for spray cleaning of a paint roller carried on the roller support structure.

4. The paint roller cleaning appartus of claim 2 wherein detachable lock means connects said cap to said tubular barrel-shaped roller container thereby closing the container with the cap and enabling paint ladened fluid to be discharged through said fluid outlet when said container is situated in an upright position.

5. The paint roller cleaning apparatus of claim 1 wherein the motor is mounted on an exterior of said roller container and has a drive shaft extending through one of said C-shaped sections into an interior of said tubular barrel-shaped roller container, a motor coupler, means keying said motor coupler to said drive shaft, a roller coupler, means connecting said roller coupler in co-axial driving connection to said motor coupler, and means on said roller coupler for connecting said roller coupler to a paint roller structure with said drive shaft connected to said couplers being operable to rotate a paint roller structure in said tubular barrel-shaped roller container radially adjacent to said tubular water spray bar.

6. The paint roller cleaning apparatus of claim 1 wherein said C-shaped sections has hasp locking means on its longitudinal edges remote from said hinge means permitting said C-shaped sections to be locked and unlocked for insertion and cleansing of a paint roller structure in said tubular barrel-shaped roller container.

7. The paint roller cleaning apparatus of claim 1 wherein said fluid outlet on said cap includes an externally threaded nipple enabling a hose line to be connected by threads to said threaded nipple.

8. The paint roller cleaning apparatus of claim 1 wherein said container has a handle for manually holding the tubular barrel-shaped roller container upright while water is sprayed radially against an outer circumferential surface of the paint roller to be cleaned.

9. The paint roller cleaning apparatus of claim 1 wherein said one of the C-shaped sections has a series of longitudinally spaced support blocks attached thereto, said blocks having support arm slots, an upright support arm engageable in any one of said slots and oriented for supporting said roller support structure at its end remote from said motor whereby the roller support structure is supported at opposite ends for free rotary movement within said container for spray cleaning of a paint roller carried on the roller support structure.

10. The paint roller cleaning apparatus of claim 9 wherein the motor is mounted on an exterior of said roller container and has a drive shaft extending through one of said C-shaped sections into an interior of said tubular barrel-shaped roller container, a motor coupler, means keying said motor coupler to said drive shaft, a roller coupler, means connecting said roller coupler in co-axial driving connection to said motor coupler, and means on said roller coupler for connecting said roller coupler to a paint roller structure with said drive shaft connected to said couplers being operable to rotate a paint roller structure in said tubular barrel-shaped roller container radially adjacent to water discharge holes in said tubular water spray bar.

11. The paint roller cleaning apparatus of claim 1 wherein a discharge outlet is provided in an end of said container, said container having a handle adjacent said motor for manually holding the tubular barrel-shaped roller container upright while water is sprayed radially against an outer circumferential surface of the paint roller to be cleaned and where water is then allowed to drain exteriorly of said container through said discharge outlet.

12. A paint roller cleaning apparatus comprising a tubular barrel-shaped roller container, said container including two C-shaped sections, hinge means joining said C-shaped sections along adjacent edges and with the C-shaped sections being relatively movable to one another into open and closed positions for enabling a paint roller to be inserted into the container for cleaning, a motor retainingly mounted on one end of said tubular barrel-shaped roller container, a roller coupler being located inside of said tubular barrel-shaped roller container and being connected to said motor for driving connection to one end of a paint roller to rotate a paint roller within said tubular barrel-shaped roller container, a removable cap mounted on an opposite end of said tubular barrel-shaped roller container, a tubular water spray bar fixedly mounted inside of said tubular barrel-shaped roller container for spraying water on an outside surface of a paint roller as it is rotated by said motor, the cap having a fluid outlet for discharge of water from a lower end of the container, and roller support means mounted interiorly of said tubular barrel-shaped roller container for supporting an opposite end of a paint roller adjacent to said cap, said means comprising a series of longitudinally spaced support blocks attached thereto, said blocks having support arm slots, an upright support arm engageable in any one of said slots and oriented for supporting said roller support structure at its end remote from said motor whereby the roller support structure is supported at opposite ends for free rotary movement within said container for spray cleaning of a paint roller carried on the roller support structure.

13. The paint roller cleaning apparatus of claim 12 wherein the motor is mounted on an exterior of said roller container and has a drive shaft extending through one of said C-shaped sections into an interior of said tubular barrel-shaped roller container, a motor coupler, means keying said motor coupler to said drive shaft, a roller coupler, means connecting said roller coupler in co-axial driving connection to said motor coupler, and means on said roller coupler for connecting said roller coupler to a paint roller structure with said drive shaft connected to said couplers being operable to rotate a paint roller structure in said tubular barrel-shaped roller container radially adjacent to said tubular water spray bar.

14. The paint roller cleaning apparatus of claim 12 wherein said container has a handle adjacent the motor for manually holding the tubular barrel-shaped roller container upright while water is sprayed radially against an outer circumferential surface of the paint roller to be cleaned, the C-shaped sections being comprised of a synthetic plastic with one of said sections being transparent enabling viewing of an interior of the tubular barrel-shaped roller container.

* * * * *